United States Patent [19]

Treiman

[11] 4,312,464

[45] Jan. 26, 1982

[54] LATCHABLE GARMENT HANGER

[76] Inventor: Alfred A. Treiman, 1519 Easterly Ter., Los Angeles, Calif. 90026

[21] Appl. No.: 154,160

[22] Filed: May 28, 1980

[51] Int. Cl.[3] ..... A47J 51/098

[52] U.S. Cl. ..... 223/85; 223/92; 211/115; 248/340; D6/247

[58] Field of Search ..... 223/85, 92, DIG. 4; 206/278, 291, 300; 211/113, 115; 248/339, 340; D6/247, 257

[56] References Cited

U.S. PATENT DOCUMENTS

| | | | |
|---|---|---|---|
| 902,078 | 10/1908 | Hawley et al. | 223/92 |
| 3,069,054 | 12/1962 | Treiman | 223/92 |
| 3,191,770 | 6/1978 | Zuckerman | 223/85 X |
| 4,074,838 | 2/1978 | Blasnik et al. | 223/85 |
| 4,185,768 | 1/1980 | Treiman | 223/85 |
| 4,187,967 | 2/1980 | Garrison | 223/92 |

*Primary Examiner*—Robert Mackey

[57] ABSTRACT

This invention comprises a latchable swivel hook garment hanger in which the swivelling hook may be latched in any radial position relative to the hanger body and unlatched to swivel, repeatedly at will; it has a hanger body containing a bore for receiving, through its top end, the elongated shaft portion of the hook member, and, through its bottom end, a latching member, such as a wing bolt, set screw, et.,; the bore is interrupted by a window-like opening in the hanger body; the segment of the hook shaft coming within the window includes a means, such as a flattened portion alone, or a detent in combination with a washer, to limit axial movement of the hook shaft while permitting it to swivel freely. The latching member is axially movable within its bore segment to axially engage or disengage the hook shaft. When the latching member and shaft are in their engaged position the latching member is operative to latch the hook member in any desired radial position; when the latching member and shaft are disengaged the hook member swivels freely.

5 Claims, 2 Drawing Figures

LATCHABLE GARMENT HANGER

BACKGROUND OF THE INVENTION

The present invention relates to latchable garment hangers. More particularly, the invention relates to a garment hanger having a hook member which may alternately swivel freely relative to the hanger body, or be fixed against swivelling movement relative to the hanger body, as desired.

The vast majority of women and children's clothing displayed in retail establishments is hung on lightweight, generally plastic, hangers, which have swivelling hooks. These types of hangers are preferred by retailers for shopper convenience. However, manufacturers find such swivel hook hangers disadvantageous because the hooks have a tendency to become tangled with each other, thereby rendering shipping, storage, and handling of the garments in bulk more difficult. Heretofore, garments have generally been shipped from the manufacturer on one piece non-rotatable plastic garment hangers; the garments are usually then transferred to a swivel hook hanger at the retail outlet, and the shipping hangers discarded.

Clearly, a dual purpose hanger acceptable to both manufacturers (shippers) and retailers would reduce hanger wastage and contribute toward reducing or a least minimizing increases in clothing costs.

My U.S. Pat. No. 4,185,768, issued Jan. 29, 1980, and my U.S. Patent Application No. 111,893, filed Jan. 14, 1980, describe latching members adapted for use with certain types of known hangers. Essentially, these latching members comprise pieces which are insertable in a window opening of the hanger and act to wedge the shaft of the hook member against swivel movement. The latching piece can be inserted in the window opening of the hanger by the hanger manufacturer prior to shipment of the hangers to clothing manufacturers, and removed by the retailer to restore swivelling action.

While the latching members disclosed in my aforementioned patent and patent application are simple and effective, there remain certain possible commercial and economic disadvantages that are avoided by the latching mechanism disclosed herein.

First, they are applicable only to hangers in which the window opening and flattened portion of the hook shaft within are large enough to enable the latching member to function; they are not applicable to the small window type of hanger with detent and washer means for hook retention. However, the latter type of hanger, comprising a substantial part of the commercial market, is compatible with the latching means disclosed herein.

Second, in the large window type, to which the previously disclosed latching means are applicable, the flat segment of the hook shaft must either be exactly in the plane of the hanger body (U.S. Pat. No. 4,185,768), or else exactly perpendicular to the plane of the hanger body (Application Ser. No. 111,893). Although accurate swaging may be readily accomplished in either case, manufacturing costs are increased and mis-strikes will occur, resulting in hangers saleable for ordinary use but not for latchable use. Such is not the case for the latching means described herein, no such accuracy being required.

Third, as noted, latching members previously disclosed are designed to latch the hanger hook only in the plane of the hanger body. While this is desirable and sufficient for mass handling, storage, and shipping, there are other latchable positions of the hanger hook which may be desired, for example in the window or interior display of garments by whole-salers and retailers. The invention described herein provides for latching the hanger hook in any position.

Fourth, the latching means previously disclosed will, by their very nature, most likely be molded out of petroleum based plastics and, upon their necessary removal by the retailer, will be wastefully discarded. The latching member disclosed herein will not require the use of petroleum plastics, will not require removal (saving labor), will remain for use as may be desired by the ultimate garment consumer, and will thus eliminate or reduce waste.

An alternative to my above-mentioned prior invention is disclosed in U.S. Pat. No. 4,074,838, issued Feb. 21, 1978 to Blasnik et al. The Blasnik et al patent discloses an intricate garment hanger requiring special molding techniques. A corded channel in the hanger receives a hook, which is axially displaceable between a fixed position and a swivelling position. The tooling required to achieve this result is expensive and may result in lessened strength of the hanger.

U.S. Pat. No. 3,191,770, issued June 29, 1975, to Zuckerman discloses an arrangement for locking a group of garment hangers together for shipping or storage. An alignment rod is inserted through the aligned window openings of the the hangers; the rod acts as a wedge against the flattened portion of the hanger hook stem or shaft to prevent swivelling movement of the hook. The Zuckerman device is not designed or intended for use with individual hangers having clothing hung thereon.

The present invention constitutes a significant improvement over heretofore known or available hanger latching devices. The hanger latching mechanism of the present invention comprises an integral part of the hanger; it permits the hanger to be readily and repeatable latched (in any position) and unlatched by the shipper, the retailer and the customer.

SUMMARY OF THE INVENTION

This invention comprises a latchable swivel hook garment hanger in which the swivelling hook may be latched in any radial position relative to the hanger body and unlatched to swivel, repeatedly at will. A hanger body contains a bore for receiving, through its top end, the elongated shaft portion of the hook member. A latching member, such as a wing bolt, set screw, etc., is received through the bottom end of the bore. The bore is interrupted by a window-like opening in the hanger body; the segment of the hook shaft coming within the window includes a means, such as a flattened portion alone, or a detent in combination with a washer, to limit axial movement of the hook shaft while permitting it to swivel freely. The latching member is axially movable within its bore segment to axially engage or disengage the hook shaft. When the latching member and shaft are in their engaged position the latching member is operative to latch the hook member in any desired radial position; when the latching member and shaft are disengaged the hook member may then swivel freely.

DESCRIPTION OF PREFERRED EMBODIMENTS

Figure 1:
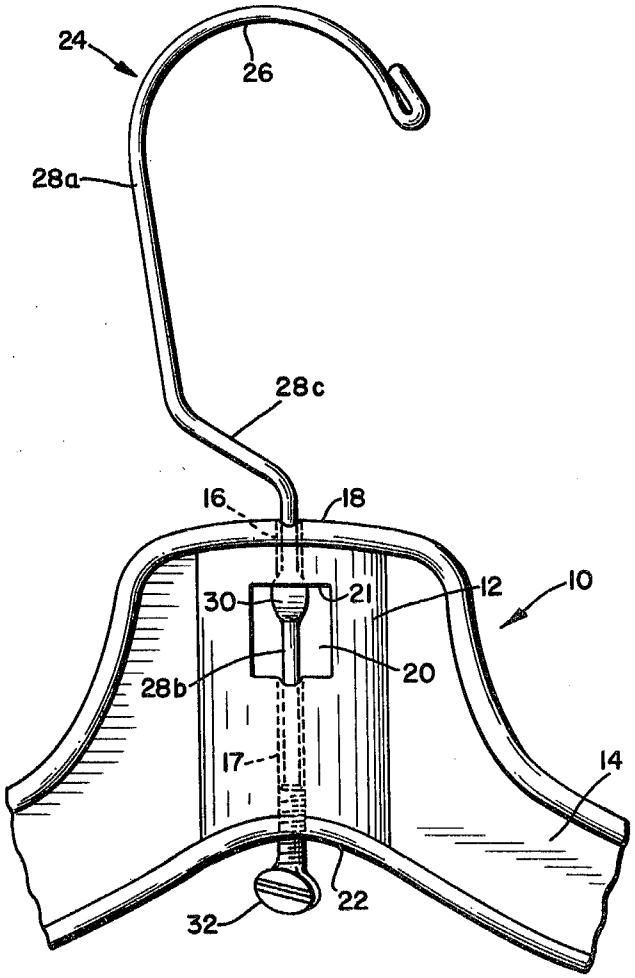
FIG. 1 shows an embodiment of this invention in connection with one known type of hanger, having a large window opening and substantial shaft flare detent.
Figure 2:
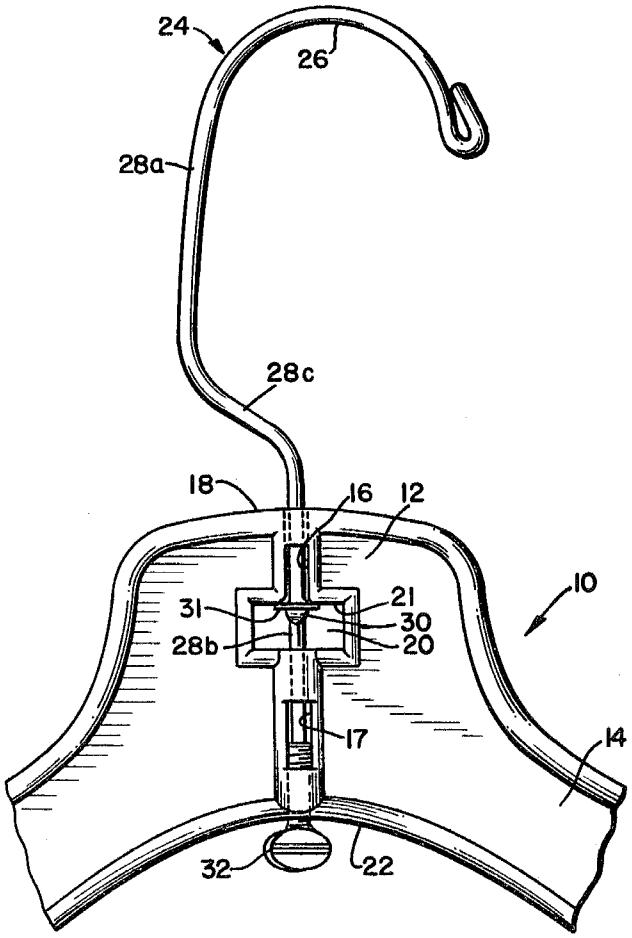
FIG. 2 shows an embodiment of this invention in connection with another known type of hanger, having a small window opening, small shaft flare, and a retaining washer.

Referring to the drawing, like parts in FIGS. 1 and 2 will be designated for convenience with the same reference numeral.

Each of the drawing figures shows the center portion of a typical hanger body 10. The hanger body 10 comprises a central body portion 12, from which arms 14 (only a short portion of which are shown) extend outwardly in opposite directions substantially in a plane. A vertical bore 16 extends downwardly into the central portion 12 from a top face 18 of the hanger body 10 (proximal end) through to a bottom face 22 of the hanger body (distal end). A window opening 20 in the central portion 12 of the hanger body interrupts bore 16 between its proximal and distal ends.

As shown in FIGS. 1 and 2, and in various prior art patents to which reference is made above, window 20 may have any of a number of desired shapes. In heretofore known hangers, the window opening 20 either interrupted the bore 16 or, in the alternative, bore 16 extended only from upper surface 10 to window 20. In essentially all known commercial coat hangers of this general type, bore 16 is smooth surfaced and does not extend all the way through body 10.

In the invention described and claimed here, bore 16 extends all the way through body 10 to define a through opening between the top face 18 and a bottom face 22 of hanger body 10. Preferably and advantageously, at least the lower portion 17 of bore 16 in the region of bottom face 22 has an internally threaded surface, the purpose of which will be described below.

Like known garment hangers, the hanger of this invention includes a hook member 24 having an inverted, substantially U-shaped hook portion 26 which fits over and rests on any suitable bar or other hook support arrangement as is well known. An elongated shaft portion 28 extends downwardly from the hook portion 26. Shaft 28 is generally comprised of two sections **28*a*, 28*b* offset from each other by offset section 28*c***. The purpose and advantages of this offset structural arrangement are well known to those skilled in the pertinent art.

Shaft portion **28*b* extends downward through the vertical bore 16; the diameter of shaft portion 28*b* is sufficiently smaller than the diameter of bore 16 to permit substantially free swivelling movement of the hanger body 10 and hook member 24 relative to each other. Means are provided in the shaft 28*b* to effectively enlarge at least a portion of its diameter within window opening 20. In one embodiment (FIG. 1), the shaft portion 28*b* includes a flattened and widened detent portion 30 located in the window opening region 20 and extending radially outward an amount greater than the radius of the vertical bore 20. In a second embodiment (FIG. 2), a washer or washer-like flange 31 encircles the shaft portion 28*b* above the detent 30 in the window opening 20; other like stops may be provided to perform the functions of the flattened portion 30 and/or washer 31**, to be described hereafter.

Normally, hangers of the type described heretofore have been constructed to permit free relative swivelling movement between the body portion 10 and hook member 24; a limited amount of longitudinal axial movement of the shaft 28 relative to body 10 within bore 16 is permitted. The amount of such longitudinal axial movement is a function of the size and shape of the stop means (e.g. flattened portion 30 or washer 31) and the size and shape of window opening 20, among other factors.

In the present invention, a latching member, such as wing bolt 32, is received into the portion 17 of bore 16. Alternate forms of latching members include set screws, slothead screws, philips head screws, or wedge pins, etc. Portion 17 of the bore may be initially smooth and self-threaded on initial entry of a threaded latching member or pre-threaded by various known means.

By screwing the latching member 32 into portion 17 of the bore, the latching member moves axially toward and into engagement with the bottom of shaft portion **28*b*. As latching member 32 is threaded further and further into the bore 16, the shaft portion 28*b* is pushed axially upward until the flattened portion 30 is wedged into bore 16 (as shown in FIG. 1) or the washer 31 engages the upper face 21 of the window opening (as shown in FIG. 2). Sufficient tightening force is exerted on latching member 32 to thereby produce a latching or frictional engagement between the stop member 30 or 31, respectively, and hanger body 10; the hook member 24 will thus be latched in any desired position and prevented from swivelling in bore 16. The hook member 24 may be unlatched by reverse threading latching member 32 so that it moves axially downward in bore 16 out of engagment with the bottom of shaft portion 28*b***.

As can be seen from the foregoing description, the present invention constitutes an improvement over prior hanger latching devices. The hanger hook latching mechanism of the present invention can be easily incorporated into the hanger as an integral part thereof; this is in contrast to prior latching devices, including those described in my aforementioned patent and application, which required either a separate latching member to be inserted into the window opening 20 or special manufacturing techniques. The latching mechanism of this invention has the advantage of multiple repeatability; that is, the hanger hook can be latched and unlatched at will by just a few turns of the latching member 32.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A latchable garment hanger, comprising:

a hook member having a hook portion and an elongated shaft portion;

a hanger body having a bore extending therethrough for receiving said elongated shaft portion;

means for permitting substantially free swivelling movement of said shaft within said bore while permitting only limited axial movement thereof; and latching means extending into the opposite end of said bore from said elongated shaft, said latching means being axially moveable within said bore to selectively engage and disengage said shaft, wherein said latching means is operative to prevent swivelling movement of said shaft when said latching member and shaft are in their engaged positions.

2. A latchable garment hanger according to claim 1, wherein said opposite end of said bore is internally threaded and said latching means comprises a threaded member mating with the internal threading of said bore.

3. A latchable garment hanger according to claim 1 or 2, further comprising:

a window opening located in said hanger body and interrupting said bore; and means on said shaft for effectively enlarging the diameter of at least a portion of the length of said shaft located within said window opening to limit axial travel of said shaft as a function of the relative axial dimensions of the enlarged diameter shaft portion and window opening.

4. A latchable garment hanger according to claim 3, wherein said means for effectively enlarging said shaft diameter comprises a flattened portion of said shaft; said latching means is moveable axially into engagement with said shaft to move said shaft axially upward until said flattened portion wedges into the bore opening in said window opening, thereby latching said shaft against further axial and swivelling movement; and said latching means is moveable axially away from said shaft to permit movement of said flattened portion out of wedging engagement with said hanger body.

5. A latchable garment hanger according to claim 3, wherein said means for effectively enlarging said shaft diameter comprises a washer member on said shaft; said latching means is moveable axially into engagement with said shaft to move said shaft axially upward until said washer member frictionally engages the hanger body at an edge of said window opening to thereby frictionally latch said shaft against further axial and swivelling movement; and said latching means is moveable axially away from said shaft to permit movement of said washer member away from and out of frictional engagement with the hanger body.

* * * * *